United States Patent [19]

Petty

[11] 4,336,843

[45] Jun. 29, 1982

[54] EMERGENCY WELL-CONTROL VESSEL

[75] Inventor: Terry D. Petty, New Orleans, La.

[73] Assignee: ODECO Engineers, Inc., New Orleans, La.

[21] Appl. No.: 86,501

[22] Filed: Oct. 19, 1979

[51] Int. Cl.[3] ..... A62C 3/00; E21B 35/00; E21B 43/01

[52] U.S. Cl. ..... 166/362; 166/344; 166/354; 166/363; 169/69

[58] Field of Search ..... 166/363, 364, 362, 354, 166/353, 352, 344; 169/69; 114/264, 265

[56] References Cited

U.S. PATENT DOCUMENTS

| | | | |
|---|---|---|---|
| 3,474,858 | 10/1969 | Gibson et al. | 166/354 |
| 3,548,605 | 12/1970 | Paull et al. | 405/60 |
| 3,554,290 | 1/1971 | Verdin | 166/362 X |
| 3,599,434 | 8/1971 | Missud | 405/60 |
| 3,643,741 | 2/1972 | Miranda | 405/60 X |
| 3,653,215 | 4/1972 | Crucet | 405/60 |
| 3,664,136 | 5/1972 | Laval, Jr. et al. | 405/60 |
| 3,724,555 | 4/1973 | Chiasson et al. | 169/69 X |
| 3,730,278 | 5/1973 | Roy | 169/69 X |
| 3,771,604 | 11/1973 | Norman et al. | 169/69 X |

OTHER PUBLICATIONS

Vren, *Petroleum Production Engineering, Oil Field Development,* Fourth Edition, McGraw-Hill Book Co., Inc., New York, 1956, pp. 750, 751.

*Primary Examiner*—Stephen J. Novosad
*Attorney, Agent, or Firm*—Michael P. Breston

[57] ABSTRACT

The emergency well-control vessel is capable of being moved above an offshore live oil or gas well, over which all normal controls have been lost. The vessel carries special purpose equipments and specially trained personnel for the purpose of bringing the erupted well under control, thereby stopping the pollution of the water body with the ejected formation fluids which form a so-called "plume". Such equipment is adapted to allow the vessel to move over and continue to dispel the plume while simultaneously attempting to regain control of the well. In one aspect, control of the abandoned wellhead and blowout preventers is established with divers working from the vessel or from an auxiliary craft. After control of the blowout preventer stack is confirmed and the same is fully operational, a kill string is lowered through the open blowout preventer stack and as deep down into the well as necessary. Thereafter, weighted fluid is circulated down the kill string and up through the annulus to thereby eventually overcome the formation fluid pressure with greater hydrostatic pressure. In other aspects, the flow can be sealed off with packoffs established against the well casing or against the formation.

10 Claims, 9 Drawing Figures

EMERGENCY WELL-CONTROL VESSEL

BACKGROUND OF THE INVENTION

Offshore drilling on the continental shelves is progressing into deeper and deeper waters, and therefore, frequently requires subsea wellheads and floating drilling equipment. The technology surrounding offshore drilling is well developed. However, no practical equipment is presently available to the industry for the purpose of regaining the control of an abandoned wellhead on the seabed after the same has erupted and is spilling formation fluids into the sea. The environmental pollution caused by such outpouring of formation liquids and gases can have disastrous consequences, as witnessed the recent pollution created over a large section of the Gulf of Mexico and adjacent beaches by the erupted well off the coast of Mexico.

Typically, an oil or gas well erupts during its initial drilling. After losing control of the well, the floating drilling rig abandons the well being drilled as quickly as possible to avoid harm to its personnel and injury to its equipment. Generally, however, the subsea blowout preventer stack and the subsea wellhead remain, even though one or both may be in damaged condition. In this abandoned condition, oil and gas continue to flow through the wellhead, the well formation, or the well casing. The spill forms a so-called "plume". Usually the plume has its apex at the top of the blowout preventer stack. The plume has a conical shape whose base is at the sea surface and covers a relatively large and increasing area. With the hydrocarbon fluids on the sea surface, conditions are ripe for a fire to erupt. Usually, the fire erupts before the floating drilling rig has a chance to disconnect and run away from the drilling site. Techniques have been developed for the drilling rig to put such a fire out and to continue with the emergency evacuation procedures.

The objects of the invention are to move over the plume, as soon as possible, with an emergency well-control vessel, which is equipped to prevent re-ignition of the plume, to use its special equipment and trained personnel to gain control of the abandoned well, and to stop as quickly as possible the polluting flow of hydrocarbon fluids into the water body of the sea.

SUMMARY OF THE INVENTION

The emergency well-control vessel is capable of being moved above a live oil or gas well, over which all normal controls have been lost. The vessel carries special purpose equipments and specially trained personnel for the purpose of bringing the erupted well under control, thereby stopping the pollution of the water body with the ejected formation fluids which form a so-called "plume". Such equipment is adapted to allow the vessel to move over and continue to dispel the plume while simultaneously attempting to regain control of the well. The special purpose equipments include: a salt water spray system to lessen the risk of ignition of the plume; a very large air blower system to dilute the accumulation of gases under and in the immediate vicinity of the vessel; a propeller system to horizontally displace the plume as the formation fluids rise to the sea surface; and an extra heavy kill string for killing the live well.

The methods for using these and other such equipments and tools may vary. In one aspect, control of the well is established with divers working from the vessel or from an auxiliary craft. After control of the blowout preventer stack is confirmed and the same is made fully operational, the kill string is lowered through the open blowout preventer stack and as deep down into the well as necessary. The blowout preventers are then closed around the kill string and thereafter weighted fluid is circulated down the kill string and up through the annulus to thereby eventually overcome the formation fluid pressure with greater hydrostatic pressure, thereby causing the flow from the subsea wellhead to stop. In other aspects, the flow can be sealed off with a packoff established against the well casing or against the formation wall.

DETAILED DESCRIPTION OF THE INVENTION

Figure 1:
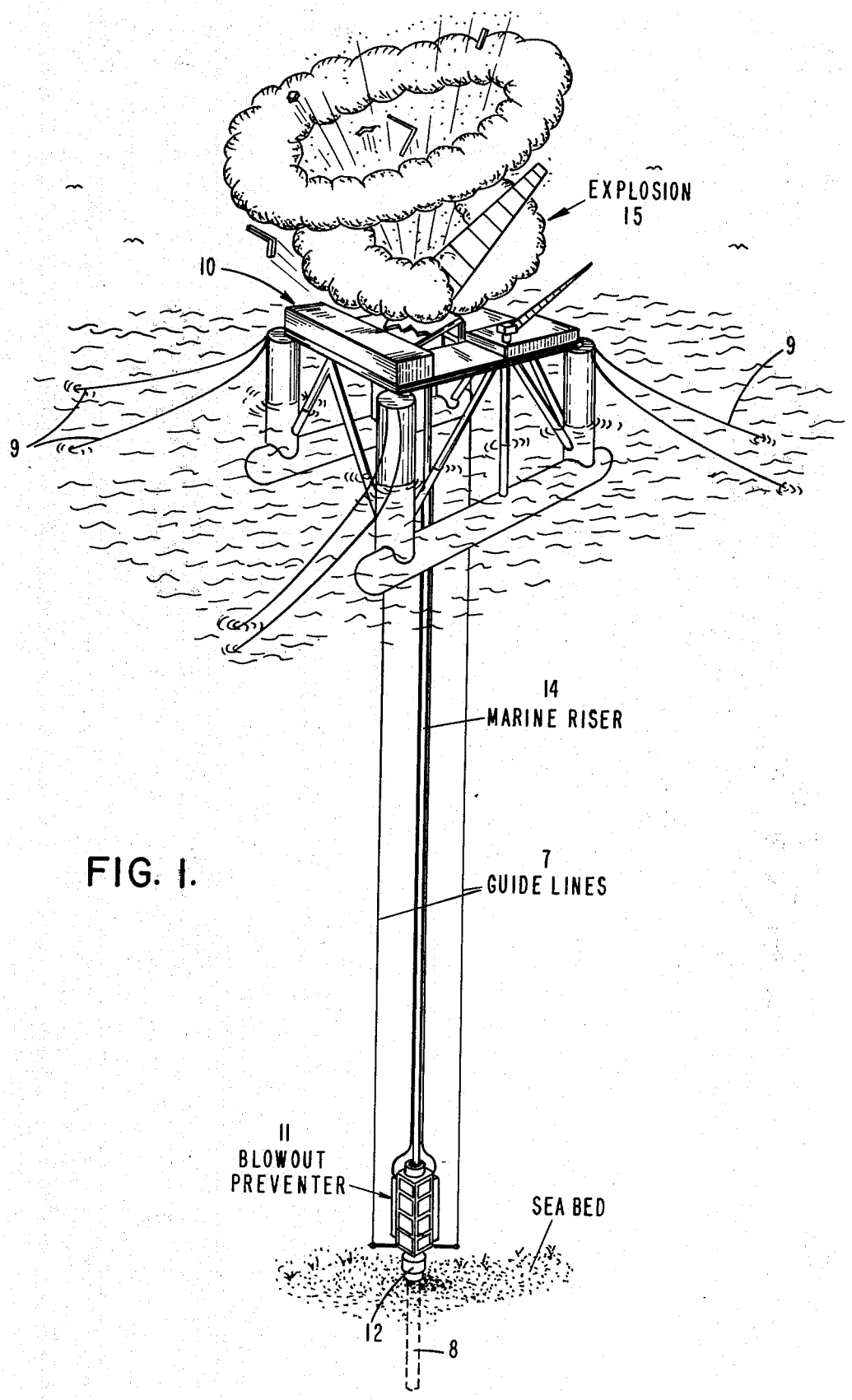
FIG. 1 shows a conventional, semi-submersible drilling rig anchored over a drilling site and floating directly over a subsea wellhead for the purpose of carrying out drilling operations, the rig is shown immediately after the occurrence of a disaster which was produced by the loss of control of the formation pressures within the underlying well bore, so that formation fluids are being delivered directly to the rig by way of the marine riser, and such fluids have just produced a fire on the rig.
Figure 2:
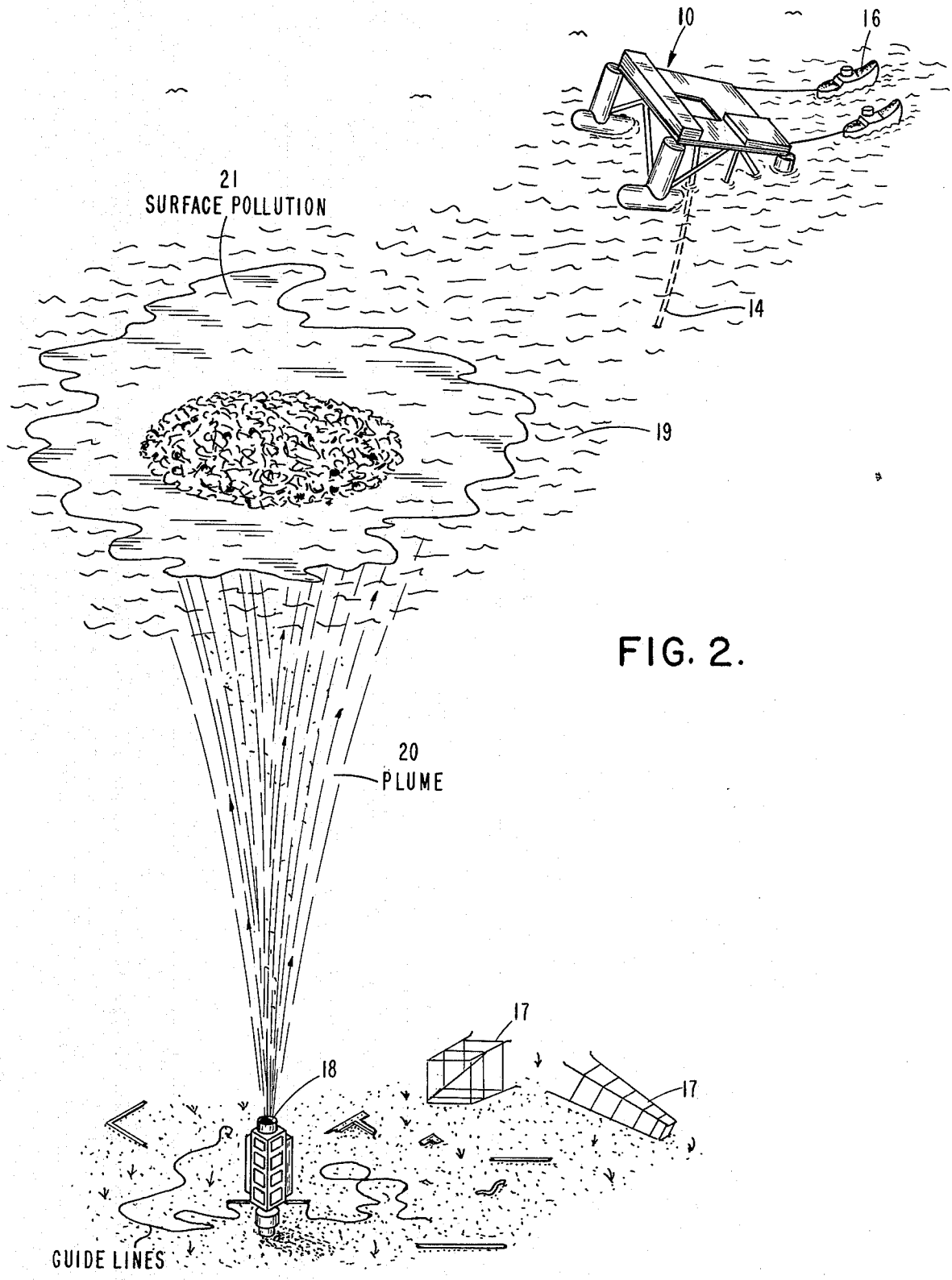
FIG. 2 illustrates that the fire shown in FIG. 1 has been put out and the crippled drilling rig has been moved out of the danger zone, but the uncontrolled wellhead continues to pour out formation fluids that form a so-called "plume" which rapidly rises to the sea surface and spreads in all directions.

FIGS. 1–2 illustrate a conventional, semi-submersible, column-stabilized, drilling rig 10 which is anchored to the sea bottom 6 by a plurality of deployed anchor lines 9 and is floating directly over a wellhead 12 on the seabed. The rig 10 is coupled to the wellhead through a marine riser 14 which contains the usual tools for the purpose of carrying out drilling operations in the well bore.

A conventional stack of blowout preventers 11 is mounted over the wellhead 12. Coupled to the base of the wellhead are guidelines 7, as is conventional in such operations. Below the wellhead 12 extends the well casing 8 into the formation earth 52 (FIG. 4*b*). The drill string and associated drilling equipments (not shown) are assumed to be in their normal positions.

When the drilling rig 10 loses control of the formation fluid pressures within the well bore, the formation fluids are delivered to the drilling vessel 10 directly through the wellhead 12, the stack of blowout preventers 11, and the marine riser 14. The rig 10 becomes rapidly filled with combustible fumes that quickly ignite to produce an explosion 15. This explosion can cause loss of life and, therefore, emergency procedures are immediately undertaken by the crew on the rig to put out the fire 15, to disconnect the rig from the seabed 6, and to pull the drilling rig 10 away from the wellhead 12 for the safety of those aboard the drilling rig and for the safety of the vessel itself. In this connection, the anchor lines 9 can be severed by explosive, sonic or other suitable devices well known in the art, see for example, U.S. Pat. No. 3,931,782, assigned to the same assignee.

FIG. 2 shows that the evacuation procedures have succeeded in putting the fire 15 out, severing all connections between the drilling vessel 10 and the wellhead 12 on one hand and the seabed on the other hand, such as through the marine riser 14, the guidelines 7, the drill string (not shown), the anchor lines 9, etc. The damaged drilling rig 10 is being towed away by tugs 16. It will be noted that the marine riser 14 is severed, and that the severed guidelines 7 and other pieces of drilling equipments 17 from the drilling rig 10 are scattered on the seabed 6 around the wellbore. The wellhead 12 and the stack of blowout preventers 11 have managed to remain in their respective original positions, although perhaps damaged operationally. Hydrocarbon fluids and other formation fluids are pouring out from the upper end 18 of the blowout preventers 11 to form a conical plume 20 whose base reaches the sea surface 19, thereby forming a polluted area 21 which unabatingly enlarges in aerial extent.

Figure 3:
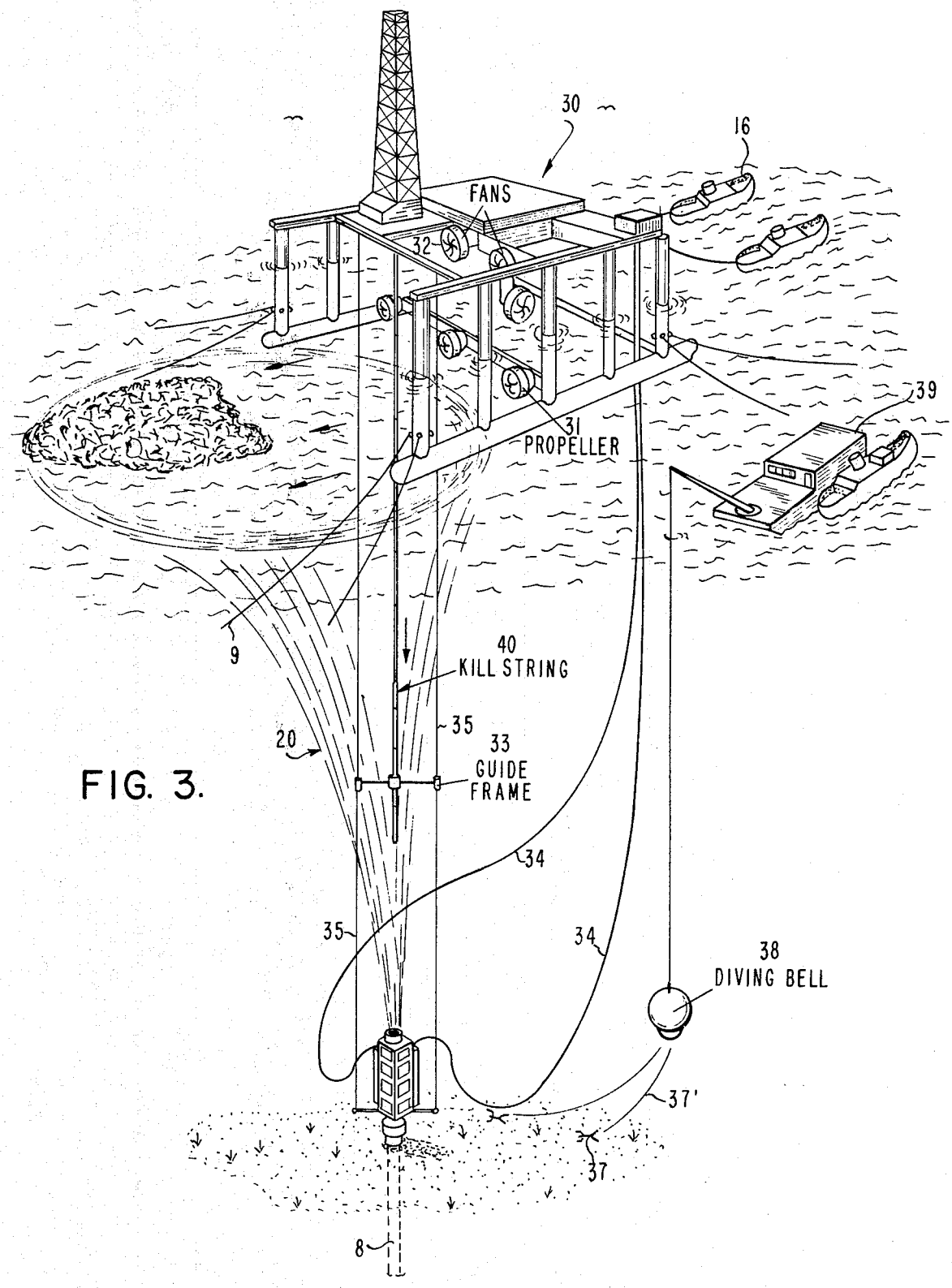
FIG. 3 is a schematic representation of the emergency well-control vessel of this invention which has been moved over the abandoned drilling site and is in the process of attempting to regain control over the wellhead and of the blowout preventers mounted thereon; the work is shown to be carried out by divers who reconnect auxiliary guidelines to the wellhead frame to allow a kill string to be lowered on a guide-frame, and the kill string is shown as being lowered through the center of the plume.

FIG. 3 is a schematic representation of the novel semi-submersible, emergency well-control vessel 30 of this invention. The emergency well-control vessel 30 can be in some respects of similar construction as the conventional drilling rig 10, but it is especially equipped to lessen the risk of re-ignition of the plume 20. It is particularly designed to be used for emergency purposes in bringing under control and then kill live oil or gas wells. It is equipped with special equipments and tools that are operated by a crew specifically trained for such dangerous emergency missions. The special equipments are selected to allow the vessel 30 to be moved over a live oil or gas well over which all control has been lost for the purpose of bringing the live well under control, thereby stopping the outpourings of hydrocarbon fluids into the water body. The crew of the vessel should include divers trained to solve the problems of well-control and the potentially disastrous problems of permanently damaging the environment from the uncontrolled flow of oil, gas and other formation fluids.

The emergency well-control vessel 30 is moved by tug boats 16 over and into the plume 20 and is positioned with its drilling derrick 29 directly above the abandoned wellhead 12, so that the drilling derrick can be used to carry out the stabbing and subsequent killing of the well. Also, the anchoring system of vessel 30 contains the usual anchor lines 9 and means (not shown) for quickly dropping the anchors so as to allow the vessel to be very rapidly pulled away in the event that the ignition of the plume does re-occur. Such special purpose anchoring means can include, as previously mentioned, explosive-operated devices which are sonically controlled, and such devices are well known in the art.

It will be understood that all equipments aboard vessel 30 are of the explosion-proof type. Also, all tools aboard the vessel are made of spark-proof materials.

Figure 5:
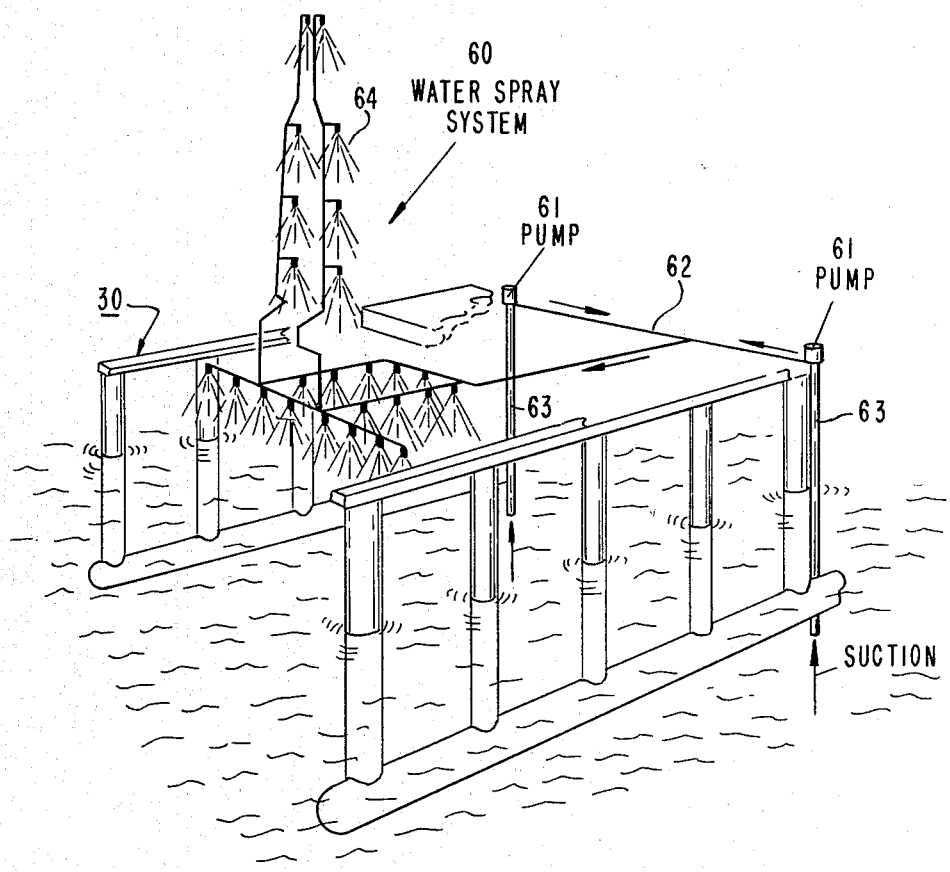
FIG. 5 shows the spark-arresting, water spray system on the emergency well-control vessel used to prevent the reignition of the plume.

The special purpose equipments provided on this emergency vessel 30 include the following: a salt water spray system 60 (FIG. 5) which comprises one or more pumps 61 having suction lines 63 extending into the sea water. Pumps 61 discharge water under pressure to feed lines 62 for feeding spray nozzles 64. The nozzles 64 are distributed throughout the entire drilling derrick 29, drill floor, substructure, and surrounding areas immediately above and around the plume 20 on the sea surface. Spray system 60 is designed to put out any sparks which may become generated on the vessel 30 that could re-ignite the plume 20.

In addition to the spray nozzles, there are also provided a plurality of very large air blowers 32, some of which are located below the main deck of vessel 30 and just above the plume 20 for the purpose of dispelling the accumulation of hydrocarbon fluids in, under and around vessel 30.

To further remove the risk of combustion, there are also provided are a plurality of propellers 31 (FIG. 3*a*) mounted below the sea surface and being attached to the structure of the vessel. Propellers 31 are driven by the vessel's power plant generators (not shown). The propellers horizontally displace the plume 20, as the flow of hydrocarbon and other formation fluids continues to rise to the sea surface.

To gain control over and to "kill" the subsea well, there is provided on vessel 30 an extra heavy kill string 40 (FIGS. 3, 3*a* and 6) which is generally made up of the following basic components: a length of small diameter drill collars 43 which are either solid or filled with lead for additional weight. The outside diameter of collars 43 is made as small as conveniently possible, but this diameter must be large enough to allow the collars to have sufficient weight so that they remain essentially vertical as they pierce the plume 20, and so that they have the necessary weight to overcome the pressures of fluid flow once they penetrate into the casing 8 of the well bore.

Immediately above the weighted collars 43 is positioned a conventional packer 44. For some applications as subsequently described, this packer can be omitted. Above the packer is a section 45 having radial ports 46 circumferentially arranged to permit circulation of heavy fluids therethrough. Directly above section 45 is coupled a string of conventional drill collars 48 above which is coupled a string of conventional drill pipes 47.

In use, the heavy fluids are made to circulate down the drill pipes 47 and through the ports 46. The circulating fluids are returned through the annulus of the wellbore, as will be understood by those skilled in this art.

Figure 3A:
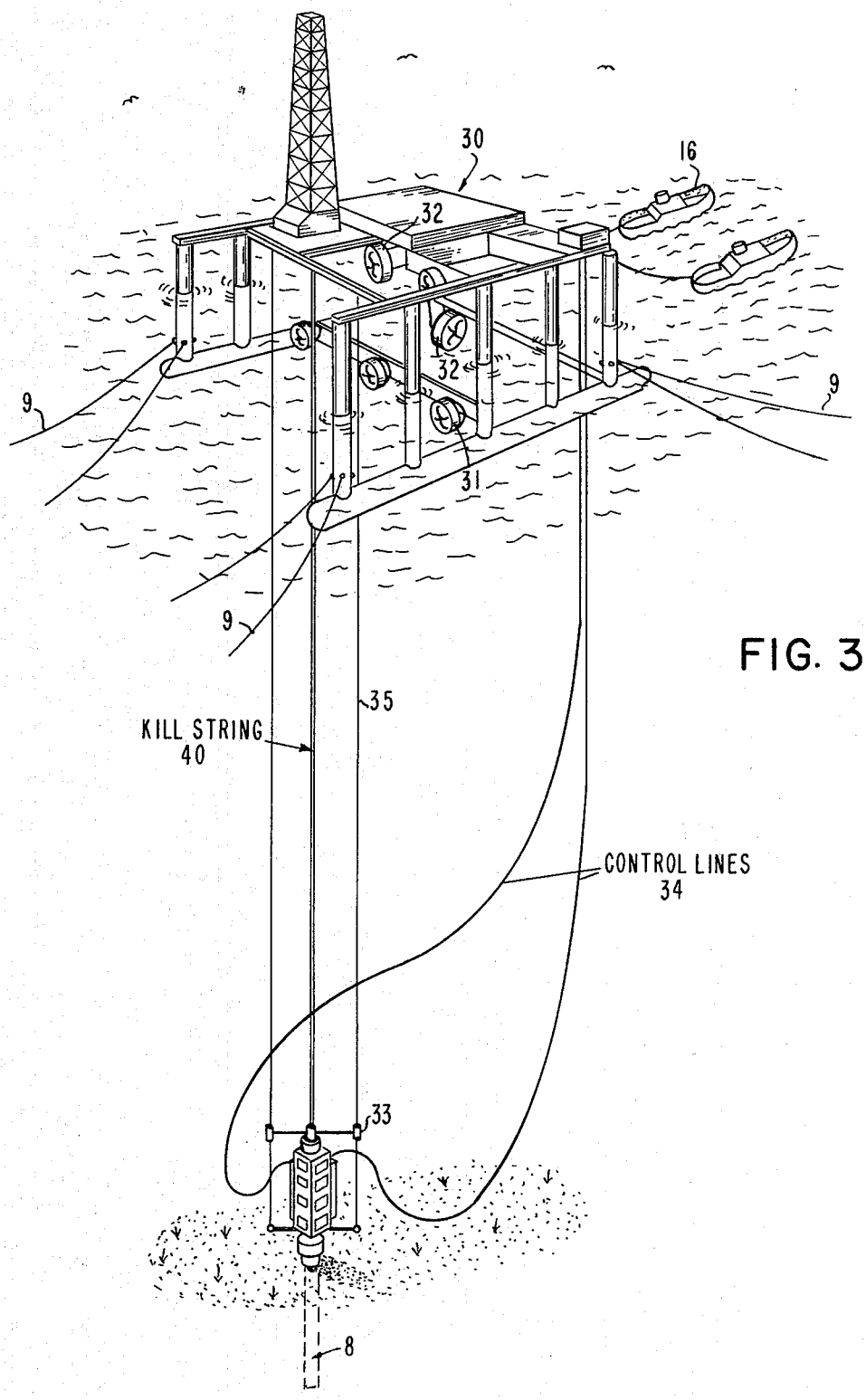
FIG. 3*a* shows that the kill string has successfully stabbed the subsea wellhead, and by means of the kill string the formation pressures have been brought under control using the blowout preventers on the wellhead or with other procedures.

In operation, the vessel 30 is moved over the top of the plume 20 directly above the wellhead 12 (FIGS. 3, 3*a*). The water spray system 60 (FIG. 5) is turned on, the fans 32 and the propellers 31 are energized to dispel the accumulation of gases and hydrocarbon fluids immediately underneath and around vessel 30. Anchor lines 9 and anchors are dropped to the seabed for holding the vessel 30 in place. It is essential that the deployed anchoring system have means or be adapted for quick anchor retrieval to allow the vessel 30 to move rapidly away in the event of a re-ignition of the plume 20.

To gain control of the well, divers 37 (FIG. 3) utilizing conventional diving equipment are employed. The divers can work either from the vessel 30 itself, or by the use of an auxiliary craft 39. In either case, a submerged diving bell 38 is employed from which tools can be operated with the aid of control lines 37'. One of the first objects for the divers 37 is to reconnect hydraulic control lines 34 of vessel 30 with the stack of blowout preventers 11, as well as repair any damage to the wellhead and/or the blowout preventers.

Figure 6:
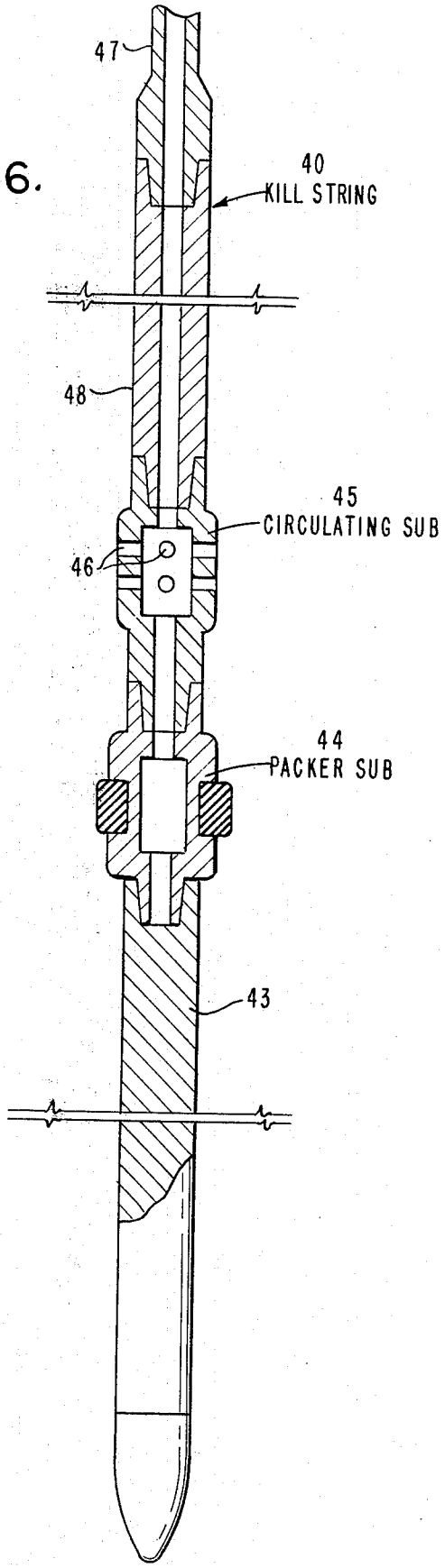
FIG. 6 is a longitudinal, sectional view of the typical components used to make up the extra heavy kill string schematically shown in FIGS. 3 and 3*a*.

After the blowout preventers 11 become operational, they are fully opened. Other divers bring down auxiliary guidelines 35 from the vessel 30 and connect them to the permanent guidebase 36 (FIG. 4) on the wellhead 12. A guideframe 33 is mounted on the auxiliary lines 35. The guideframe 33 will be used to guide the extra heavy kill string 40 from the vessel 30 in a direction so as to stab through the stack of blowout preventers 11 and downwardly through the wellhead 12 and into the well casing 8. The kill string 40 is assembled, joint by joint, as shown in FIG. 6, and guided through the top 18 of the open blowout preventers 11 utilizing the guideframe 33 until the kill string reaches a desired depth within the well.

Then, an attempt is made to close the blowout preventers 11 around the kill string. In this attempt, the packer 44 which is on the kill string is not utilized. If the blowout preventers 11 can establish an effective seal around the kill string, then large volumes of a weighted fluid are circulated down the kill string, as above described, and up through the annulus. The weight of the circulating fluid eventually overcomes the well pressures, and the greater hydrostatic pressure in the annulus causes the flow from the subsea wellhead 12 to stop.

After control of the well is gained, the conditions surrounding the vessel 30 are as shown in FIG. 3*a*.

If the sealing elements in the blowout preventers 11 have become damaged or if the rubber elements in the blowout preventers 11 fail to seal off the flow of formation fluids, alternate techniques have to be employed for the purpose of gaining control of the well.

Figure 4:
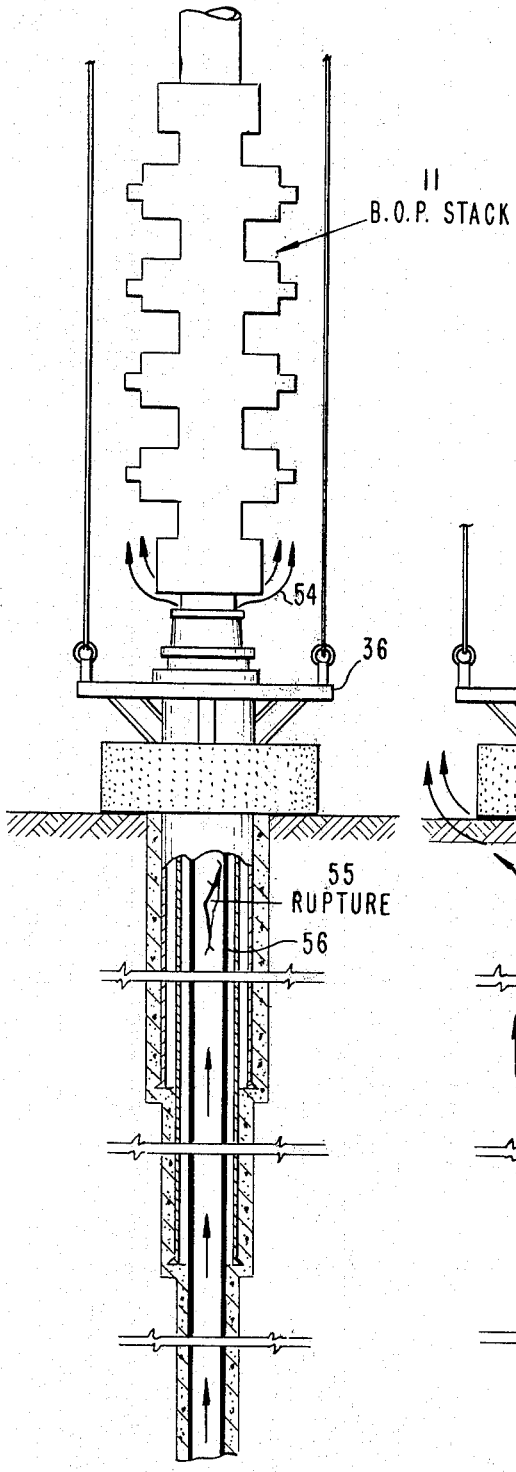
FIG. 4 illustrates that instead of the uncontrolled formation fluids escaping through the well casing and the open blowout preventers as shown in FIG. 2, the formation fluids can escape through a rupture in the well casing beneath the wellhead which is on the seabed.
Figure 4A:
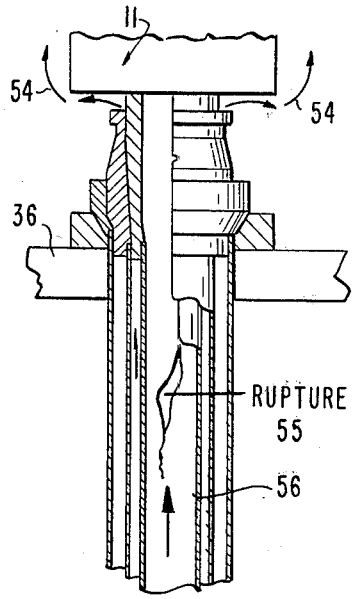
FIG. 4*a* is an enlargement of the ruptured section, shown in FIG. 4, and illustrates the escape path in greater detail.
Figure 4B:
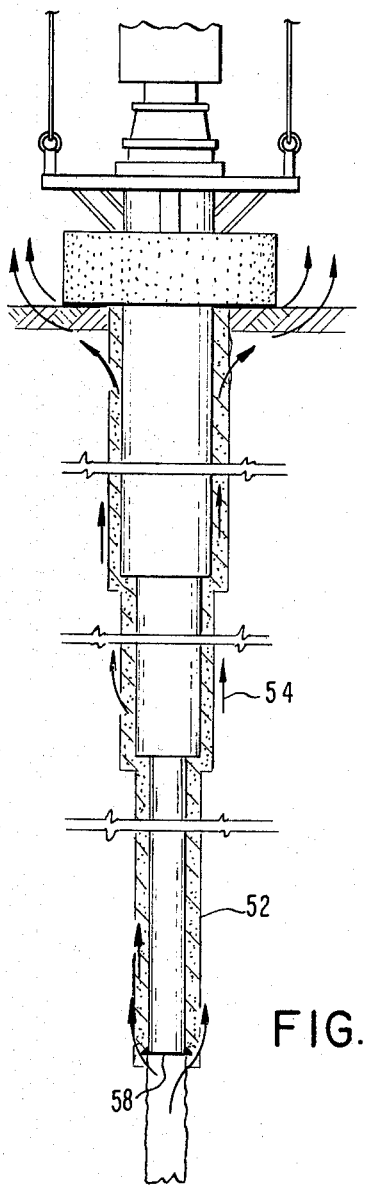
FIG. 4*b* illustrates that the loss of formation fluids can also occur near or at the casing shoe which fails to hold the formation pressures, thereby allowing the formation fluids to escape outside of the wellhead casings and through the formation wall.

FIGS. 4, 4*a* illustrate the case where well fluids, represented by the arrows 54, can also arrive from the well through a rupture 55 in a section 56 of the well casing 8. In that event, the pressure control exerted by the blowout preventers 11 is bypassed.

FIG. 4*b* illustrates that the well formation 52 can become fractured and formation fluids 54 can originate in and around the base 58 of the casing 8. In this situation, the pressure control exerted by the blowout preventers 11 is also bypassed.

In the event that the blowout preventers 11 become ineffective to stop the flow of formation fluids 54, as previously suggested, or in those cases shown in FIGS. 4, 4*a* and 4*b*, alternate steps can be employed to gain control of the well.

One alternate method involves establishing a packoff with the packer 44 against the well casing 8 or against the wall of formation 52. The use of such packoffs is well known in the art.

Yet another alternate technique is to lower the kill string 40 without packer 44 into the well as deeply as possible and to circulate large volumes of a weighted fluid down the kill string and up the annulus. This will eventually overcome the formation fluid pressures with greater hydrostatic pressure in the annulus and thereby kill the well. If the kill string 40 is employed with the packer 44 it would be necessary to inflate the packer 44 so as to packoff below the lowermost rupture 55 in the well casing 8. The particular packer 44 employed for this procedure is a matter of choice and all such packers can be hydraulically operated remotely under the controls at the vessel 30.

While the invention has been described in connection with illustrative equipments and procedures, it will be apparent to those skilled in the art that other equipments and procedures can be employed without departing from the scope of the invention as defined in the claims attached hereto.

What is claimed is:

1. An emergency well-control vessel adapted to be moved above a live oil or gas well, over which all normal controls have been lost; emergency equipment on said vessel for bringing said well under control, thereby stopping the pollution of the water body with the ejected formation fluids which form a plume, said equipment being adapted to allow the vessel to move over and continue to dispel the plume while simultaneously attempting to regain control of the well, said equipment including:

(1) a salt water spray system to lessen the risk of ignition of said plume;

(2) a very large air blower system to dilute the accumulation of gases under and in the immediate vicinity of the vessel;

(3) a propeller system to horizontally displace the plume as the formation fluids rise to the sea surface; and (4) an extra heavy kill string circulating heavy fluids through the well.

2. A method for controlling an erupted marine oil well which comprises:

positioning over the erupted well an emergency well-control vessel, dispelling from the vicinity of the well-control vessel hydrocarbon vapor issuing from the well and collecting above the surface of the water, deflecting away from the well-control vessel the plume of hydrocarbon fluids emerging from the well and rising upwardly from the well to the surface of the water, establishing a guideline connection between the well-control vessel and the wellhead equipment remaining on the sea bed, lowering a kill string from said vessel down said guideline and into the well, and pumping a well-control fluid down the kill string into the well.

3. A method according to claim 2, wherein said kill string includes a packer which is lowered into the well and sealed against the well casing prior to injection of the well-control fluid.

4. A method according to claim 3, wherein the hydrocarbon vapor is dispersed from the vicinity of the well-control vessel by the operation of fans mounted on the vessel.

5. A method according to claim 3, wherein the hydrocarbon plume is deflected away from the well-control vessel by the operation of propellers mounted on the vessel and submerged in the water below the well-control vessel.

6. A method according to claim 2, wherein the hydrocarbon vapor is dispersed from the vicinity of the well-control vessel by the operation of fans mounted on the vessel.

7. A method according to claim 6, wherein the hydrocarbon plume is deflected away from the well-control vessel by the operation of propellers mounted on the vessel and submerged in the water below the well-control vessel.

8. A method according to claim 2, wherein the hydrocarbon plume is deflected away from the well-control vessel by the operation of propellers mounted on the vessel and submerged in the water below the well-control vessel.

9. A method according to claim 2 for use with a well having a sea bed wellhead and a stack of blowout preventers, in which the blowout preventers are connected to fluid control lines on the well-control vessel by divers to effect a seal around the kill string before the well-control fluid is injected.

10. An emergency well-control vessel for controlling an erupted marine oil well, comprising:

a floating platform positionable above the erupted well, means for anchoring the platform in position above the erupted well, a sprinkler system mounted below said platform for extinguishing ignited hydrocarbon vapor issuing from the surface of the water below said platform, a fan system mounted below said platform for dispelling hydrocarbon vapor issuing from the water surface and collecting below said platform, a propeller system mounted on said vessel below the water line for deflecting the plume of hydrocarbon fluids issuing from the well away from the vessel, and means mounted on said platform for lowering a kill string into the erupted well and for pumping a well-control fluid down the kill string into the well.

* * * * *